United States Patent [19]

Rehm et al.

[11] Patent Number: 4,991,668

[45] Date of Patent: Feb. 12, 1991

[54] CONTROLLED DIRECTIONAL DRILLING SYSTEM AND METHOD

[75] Inventors: William A. Rehm; William J. McDonald; William C. Maurer; Curtis E. Leitko, Jr., all of Houston, Tex.

[73] Assignees: Maurer Engineering, Inc., Houston, Tex.; Bechtel Investments, Inc., Nev. ; part interest to each

[21] Appl. No.: 306,050

[22] Filed: Feb. 6, 1989

[51] Int. Cl.[5] ..... E21B 7/04

[52] U.S. Cl. ..... 175/61; 175/74; 175/75

[58] Field of Search ..... 175/26, 61, 74, 75, 175/101, 107, 321

[56] References Cited

U.S. PATENT DOCUMENTS

| | | | |
|---|---|---|---|
| 3,717,208 | 2/1973 | Anderson | 175/74 |
| 4,067,404 | 1/1978 | Crase | 175/75 |
| 4,667,751 | 5/1987 | Geezy et al. | 175/75 X |
| 4,817,740 | 4/1989 | Beimgraben | 175/74 |

*Primary Examiner*—William P. Neuder
*Attorney, Agent, or Firm*—Neal J. Mosely

[57] ABSTRACT

A system of apparatus for the controlled directional drilling of a deviated well bore into the earth has a fluid operated drilling motor and drill bit secured on the bottom end of a drill string. The drill bit is supported for angular drilling relative to a substantially vertical well bore by either using a bent sub for supporting the drilling motor or by using a drilling motor with a bent housing or a combination of the two. A bypass tool is connected to the bent sub or motor housing, an orienting sub and mule shoe keying sub are connected to the bypass tool, and a surveying tool is connected in the drill string above the orienting sub and mule shoe sub. The bypass tool is in fluid connection with the motor and has a telescopic housing and a valve for circulating fluid into the bore hole to flush cuttings and debris therefrom. The surveying tool determines and controls the direction of drilling. The orienting sub and mule shoe keying sub orients the position of the motor and drill bit in relation to the surveying tool.

38 Claims, 6 Drawing Sheets

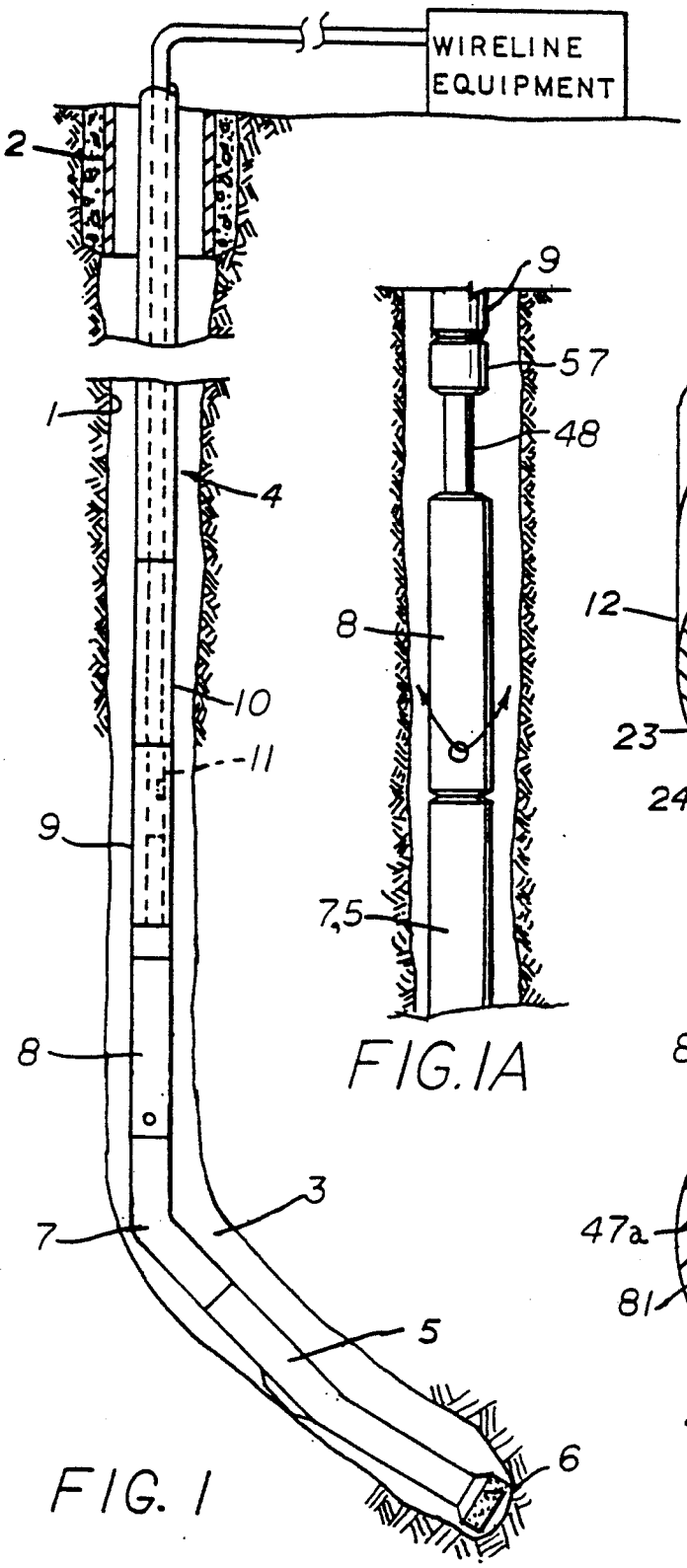
FIG. 1
FIG. 1A
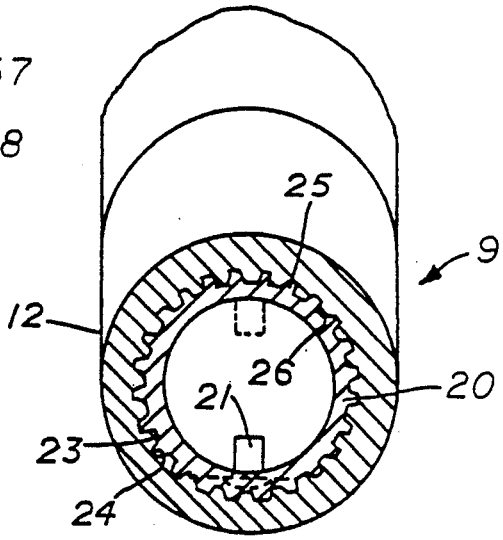
FIG. 5
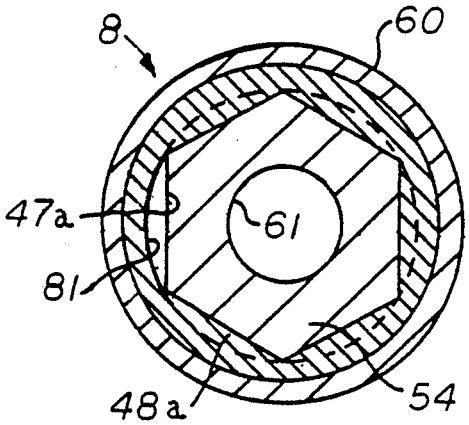
FIG. 8

CONTROLLED DIRECTIONAL DRILLING SYSTEM AND METHOD

BACKGROUND OF THE INVENTION

1. Field of the Invention

This invention relates to new and useful improvements in controlled drilling systems, and more particularly to a system of apparatus and method for controlled directional drilling utilizing a down hole motor with orienting and circulating tools and apparatus for orienting a bent sub or bent motor housing in relation to the surveying tool in the drill string to control the direction of the hole being drilled.

2. Brief Description of the Prior Art

Drilling systems wherein a drill bit is operated by a down hole motor, such as positive displacement fluid motors or turbine driven motors are known in the art. In such motors, the drill bit is rotated by a rotor turned by flow of fluid, such as drilling fluid through the motor assembly. These down hole motors and drills are used in many cases for angular drilling of wells by supporting the motor on a bent sub or by using a motor having a bent housing. A surveying tool connected in the drill string above the motor senses and controls the direction of drilling. In such apparatus, it is necessary to locate the bend in the bent sub or the bend in a bent motor housing accurately in relation to the surveying tool to permit accurate control. An accurate orientation of the bent sub or bent motor housing in relation to the surveying tool has been difficult with prior art equipment and such difficulties have been largely overcome by this invention.

In drilling with down hole motors, one major problem encountered is that cuttings and debris sometimes block the bore hole. This has been partially overcome by lifting the entire motor assemble off bottom to allow the motor and bit to spin and to use the drilling fluid to blow out the cuttings and debris. There have been attempts to provide a mechanism to blow out cuttings and debris without lifting the motor and bit off bottom but these have not been effective. Devices which open a valve by lifting the drill string have had the disadvantage that the fluid pressure acting across the motor and bit tends to lock the valve in an open position.

Slim hole drilling is less expensive than conventional drilling because it uses smaller tools, rigs, casing, and mud systems. "Slim hole drilling" as used herein refers to drilling operations in which the hole size is smaller than usual. The slim hole is drilled with less than normal diameter tools, for example, 6½" bit or less. The tight clearances in smaller casing sizes provides some advantages and some disadvantages. Buckling of the pipe is controlled by hole diameter, drill pipe and tool joint size, and the required pushing force or negative drag. Increasing the tool joint diameter reduces buckling problems, however adequate clearance is needed inside the hole and casing for circulation and pipe movement. Because the pipe is in compression when pushed into the horizontal hole and in tension when pulled out of the hole, it must be appreciably stiffer than pipe used under normal conditions. Finally, there is the effect of rotation and bending on the tool joints and larger diameter elements of the drill string.

Tschirky U.S. Pat. No. 3,879,094 discloses a down hole motor consisting of a positive displacement motor having a bearing assembly on the motor housing which has tungsten carbide radial bearings and a plurality of longitudinally spaced axial thrust bearings.

Tiraspolsky U.S. Pat. No. 3,449,030 discloses a bearing assembly for use in down hole motors which includes a plurality of spaced axial thrust bearings having woven wire annular pads which function to absorb shock.

Garrison U.S. Pat. No. 3,594,106 discloses a down hole motor assembly with longitudinally spaced axial thrust bearings and a spring mechanism for absorbing shock.

Maurer et al U.S. Pat. No. 4,114,704 discloses a turbodrill having means to use the pressure of drilling mud to reverse the application of bearing forces from the lower to the upper thrust bearings.

Maurer et al U.S. Pat. No. 4,665,997 discloses a pressure balanced bearing assembly for down hole motors.

SUMMARY OF THE INVENTION

It is therefore one object of this invention to provide a new and improved controlled directional earth drilling system and method.

It is another object of the invention to provide a system and method for horizontal slim hole drilling which is less expensive than conventional drilling.

It is another object of this invention to provide a system and method for horizontal slim hole drilling whereby a slim hole drilling assembly can be run inside small production casing, as well as in larger conventional size casing.

Another object of this invention to provide a system and method for horizontal slim hole drilling in which all drilling is done with motors and any pipe rotation is incidental to the drilling operation thereby allowing the use of conventional drill pipe.

Another object of this invention is to provide a system and method for horizontal slim hole drilling which utilizes small bit size and high rotational speeds.

Another object of this invention is to provide a system and method for horizontal slim hole drilling in which the bottom hole assembly is of minimum diameter and has no shoulders thus reducing the tendency to hang and allowing constant bit weight to be maintained.

Another object of this invention is to provide a system and method for horizontal slim hole drilling.

A further object of this invention is to provide a system and method for horizontal slim hole drilling.

A still further object of this invention is to provide a system and method for horizontal slim hole drilling which is simple in design, economical to manufacture and reliable and durable in use.

Another object of this invention is to provide a controlled directional drilling system and method utilizing a drill string having a surveying tool and a drilling motor supported thereon by a bent sub, or in lieu thereof a drilling motor having a bent housing, with means for orienting the bend in the bent sub or bent motor housing accurately in relation to the surveying tool.

Another object of this invention is to provide a controlled directional drilling system and method utilizing a drill string having a surveying tool and a drilling motor supported thereon by a bent sub, or in lieu thereof a drilling motor having a bent housing, with an orienting tool or sub for orienting the bend in the bent sub or bent motor housing accurately in relation to the surveying tool.

Another object of this invention is to provide a controlled directional drilling system and method comprising a drill string having a surveying tool and a drilling motor supported thereon by a bent sub, or in lieu thereof a drilling motor having a bent housing, with an orienting tool or sub for orienting the bend in the bent sub or bent motor housing accurately in relation to the surveying tool and a bypass tool for use in combination with the motor for earth drilling and to flush cuttings and debris from the well bore.

Another object of this invention is to provide a controlled directional drilling system and method utilizing a drill string for drilling a deviated well bore into the earth having a fluid operated drilling motor and drill bit secured on the bottom end and supported for angular drilling relative to a substantially vertical well bore, a bypass tool connected to a bent sub, or in lieu thereof a drilling motor having a bent housing, an orienting tool and mule shoe keying sub connected to the bypass tool, and a surveying tool connected in the drill string above the orienting tool and mule shoe sub.

Still another object of this invention is to provide a controlled directional drilling system and method utilizing a drill string having a bent sub or bent motor housing, a bypass tool, orienting tool and mule shoe sub, and a surveying tool which will orient the bend in the sub or motor housing accurately in relation to the surveying tool and is capable of emptying the drill string during lifting.

Still another object of this invention is to provide a controlled directional drilling system and method utilizing a drill string having a bent sub or bent motor housing, a bypass tool, orienting tool and mule shoe sub, and a surveying tool which will orient the bend in the sub or motor housing accurately in relation to the surveying tool and is capable of fine angular adjustment to orient the bend in the sub or motor housing accurately in relation to the surveying tool.

Still another object of this invention is to provide a controlled directional drilling system and method utilizing a drill string having a bent sub or bent motor housing, a bypass tool, orienting tool and mule shoe sub, and a surveying tool which will orient the bend in the sub or motor housing accurately in relation to the surveying tool and is capable of operation under high pressure conditions.

Still another object of this invention is to provide a controlled directional drilling system and method utilizing a drill string having a bent sub or bent motor housing, a bypass tool, orienting tool and mule shoe sub, and a surveying tool which will orient the bend in the sub or motor housing accurately in relation to the surveying tool and which includes means to counterbalance the pressures tending to open the bypass tool.

Other objects of this invention will come apparent from time to time throughout the specification and claims as hereinafter related.

BRIEF DESCRIPTION OF THE DRAWINGS

FIG. 1 is a view diagrammatically showing a down hole motor having a bent housing supported on a bent sub from a surveying tool by an orienting sub and bypass tool or sub in position for angular earth drilling with the well bore shown in section illustrating a preferred embodiment of the invention.

FIG. 1A is a fragmentary view of the bypass tool of the apparatus shown in FIG. 1 with the tool lifted to a position opening the bypass valve for circulation of fluid to flush the well bore.

FIG. 5 is a sectional view taken on the line 5—5 of FIG. 2B showing the splined connection for orienting the key for the mule shoe sub to position it accurately in relation to the bend in the bent sub or bent motor housing used for angular drilling.

FIG. 8 is a sectional view taken on the line 8—8 of FIG. 6B.

DESCRIPTION OF THE PREFERRED EMBODIMENT

Figure 2A:
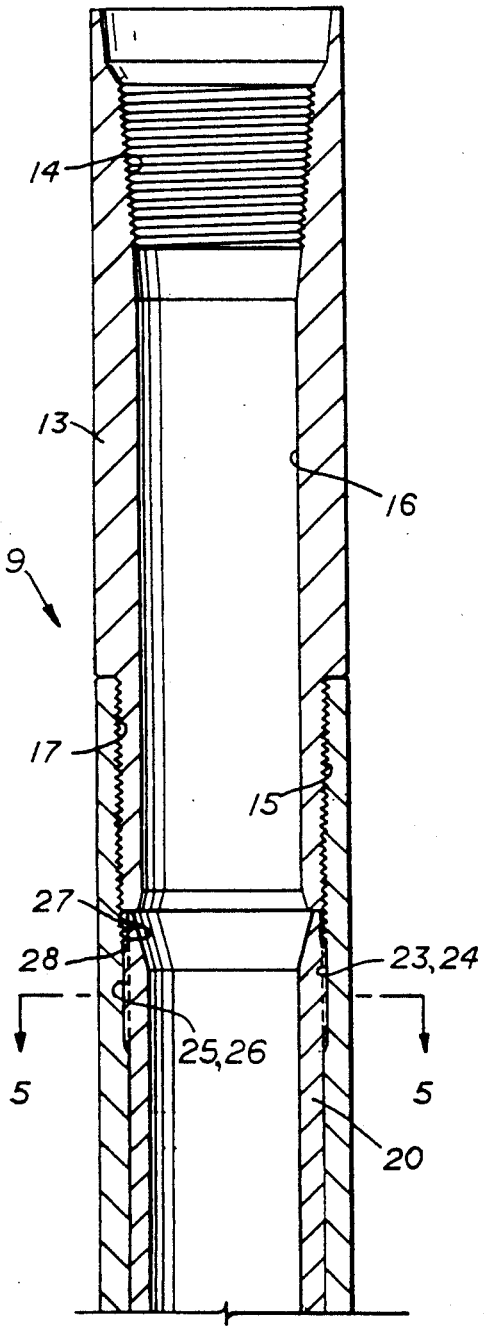
FIGS. 2A and 2B taken together constitute a longitudinal sectional view showing details of the orienting and circulating tool or sub.

Referring to the drawings by numerals of reference, and more particularly to FIG. 1, there is shown a vertical section through a bore hole 1 in the earth, with a casing 2 in place, and a lower portion 3 extending at an angle, illustrating slant or angular drilling.

The equipment described herein is primarily useful in slim hole drilling systems but can be used with larger diameter systems as well.

A drill string 4 extends into the substantially vertical portion of well bore 1 with the drilling motor 5 in the angular bore hole 3. Drilling motor 5 is a fluid operated motor with a drill bit 6 operated thereby. Motor 5 may be a positive displacement motor, e.g. a Moineau motor, or a turbodrill. The string of drill pipe 4 conducts drilling fluid through the motor assembly and into the bore hole.

Motor 5 is supported by a bent sub 7 at a substantial angle to the vertical portion of well bore 1 and has bent housing **5*b* and a deflection pad 5*a* for continuing the drilling of the well bore portion 3 at an angle to the vertical portion thereof. In FIG. 1, the motor 5 is shown in combination with a bent sub. However, it should be understood that various other combinations may be used such as; a bent sub and straight motor, a straight sub and bent motor, or and straight motor alone. Deflection pad 5*a*** acts as a fulcrum and increases the side load on the drill bit, causing it to drill along a sharper curve.

Figure 6A:
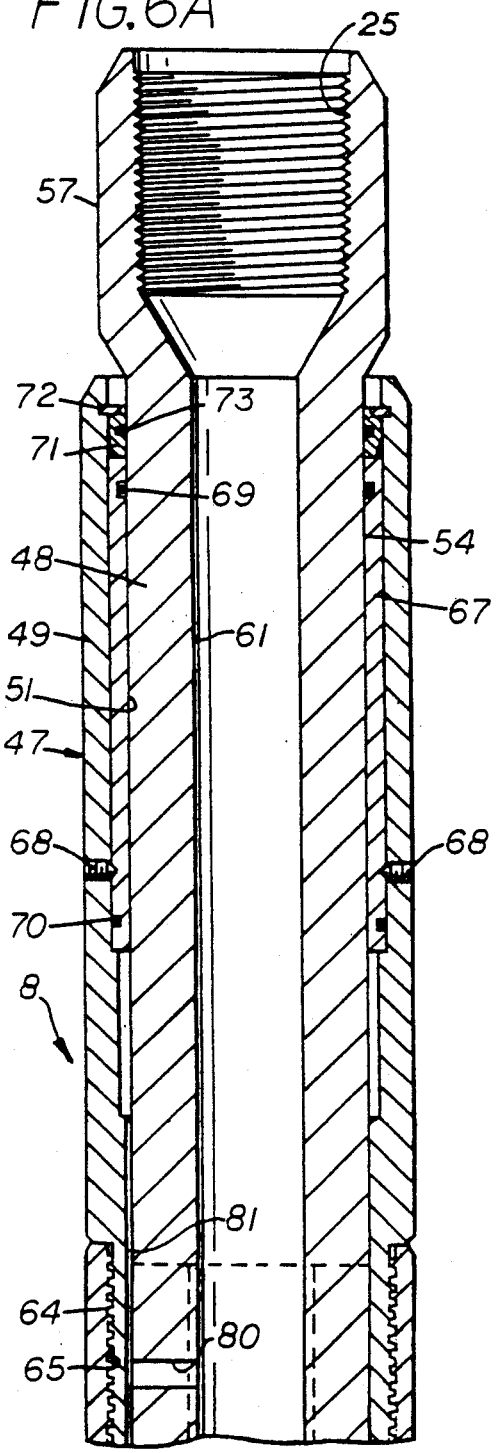
FIGS. 6A and 6B taken together constitute a longitudinal sectional view showing details of the bypass tool and its relation to the rotary shaft which carries the drill bit, showing the bypass valve in a closed position.
Figure 6B:
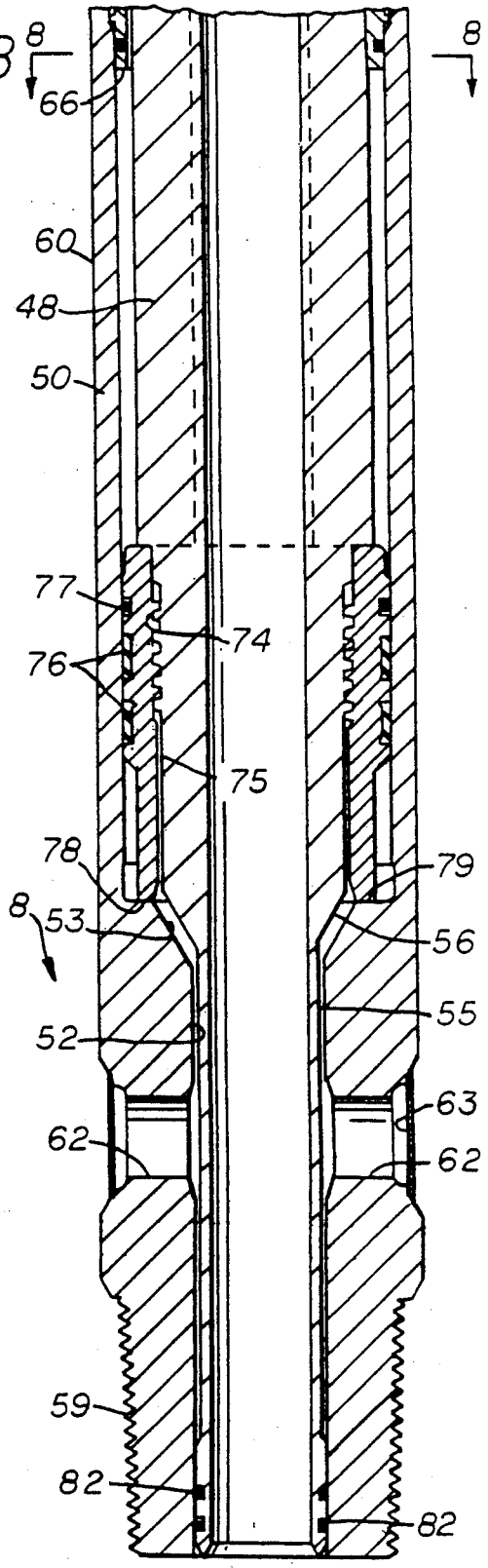
Figure 7A:
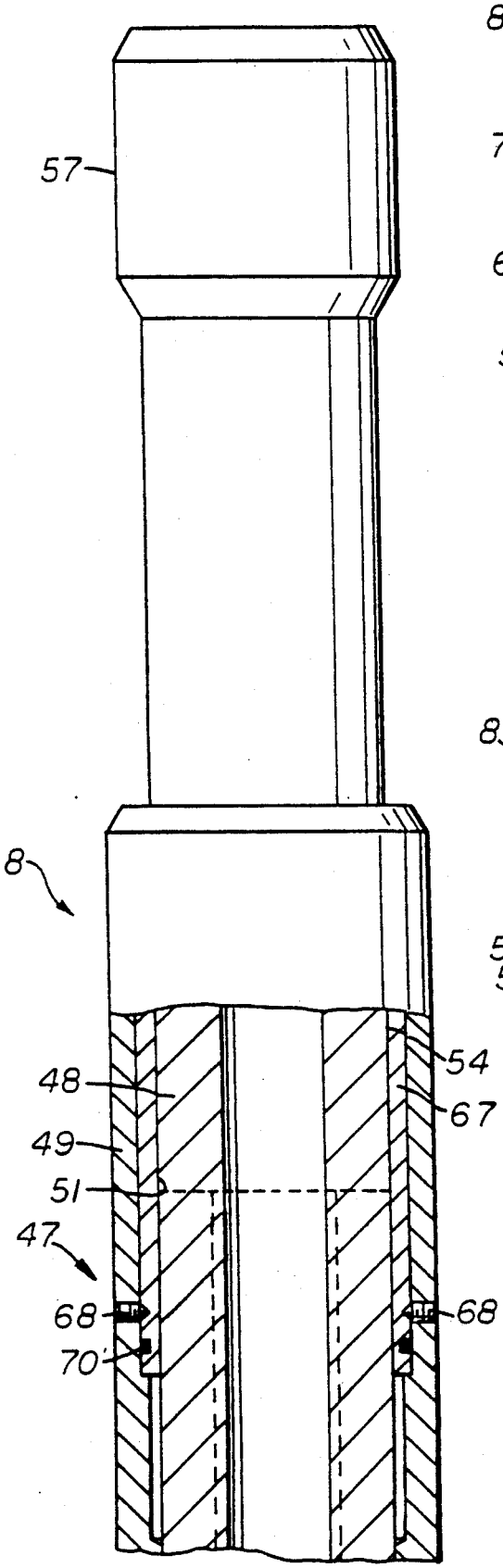
FIGS. 7A and 7B taken together constitute a longitudinal sectional view showing details of the bypass tool and its relation to the rotary shaft which carries the drill bit, showing the bypass valve in an opened position.
Figure 7B:
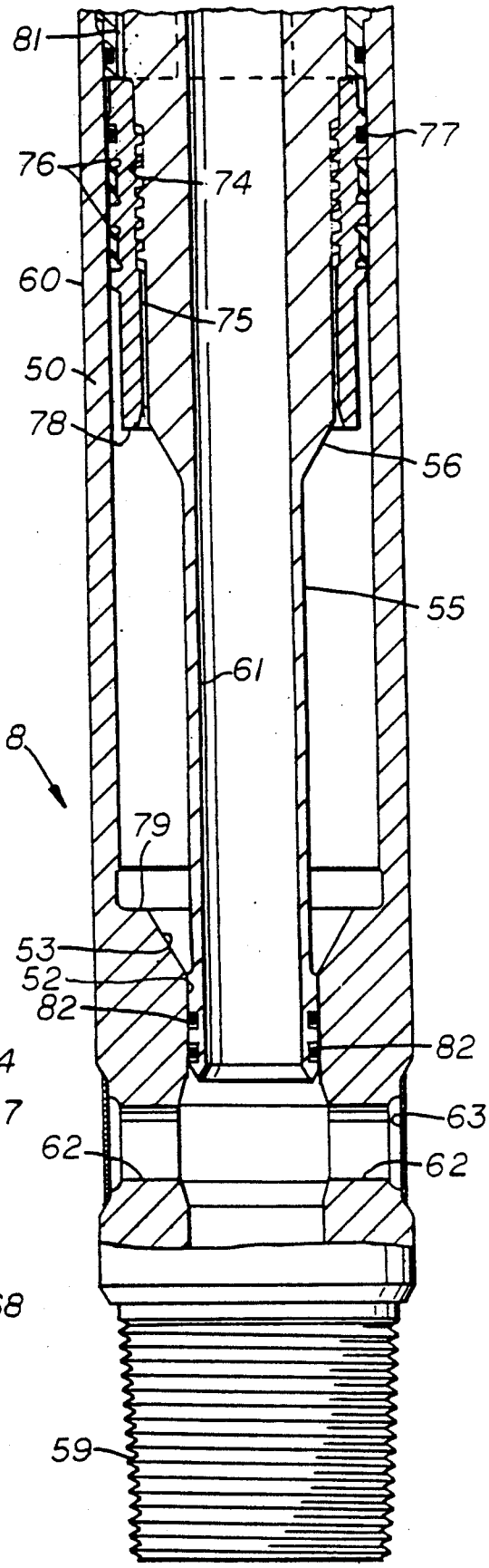

As will be described below, a bypass tool or sub 8 is connected to the top end of the bent sub or bent housing of the motor in the flow of drilling fluid which operates motor 5 and is operated as desired to direct flow of drilling fluid into the well bore 1 to flush out cuttings and debris which interferes with the drilling operation. Bypass tool or sub 8 is shown in FIGS. 1, 6A and 6B in a telescoped position and in FIGS. 1A, 7A and 7B in an extended or operated position. Bypass sub 8 is an optional feature and may or may not be used according to the conditions encountered in drilling.

A circulating and orienting sub 9 is connected at one end to bypass tool or sub 8 and to a surveying tool 10 at the other end. The circulating and orienting sub 9 includes means to adjust the angular orientation of the point of connection to bypass tool or sub 8 in relation to the connection to bent sub 7 or bent motor housing 5.

The surveying tool 10 is connected in drill string 4 above the circulating and orienting sub 9, bypass tool or sub 8, and motor 5 for determining and controlling the direction of drilling. A mule shoe keying sub 11 is connected to the surveying tool 10 for connecting and orienting the position of the motor 5 in relation to the surveying tool. Details of construction of mule shoe keying sub 11 and circulating and orienting sub or tool 9 are shown in FIGS. 2A, 2B, and 3–5 of the drawings.

Figure 2B:
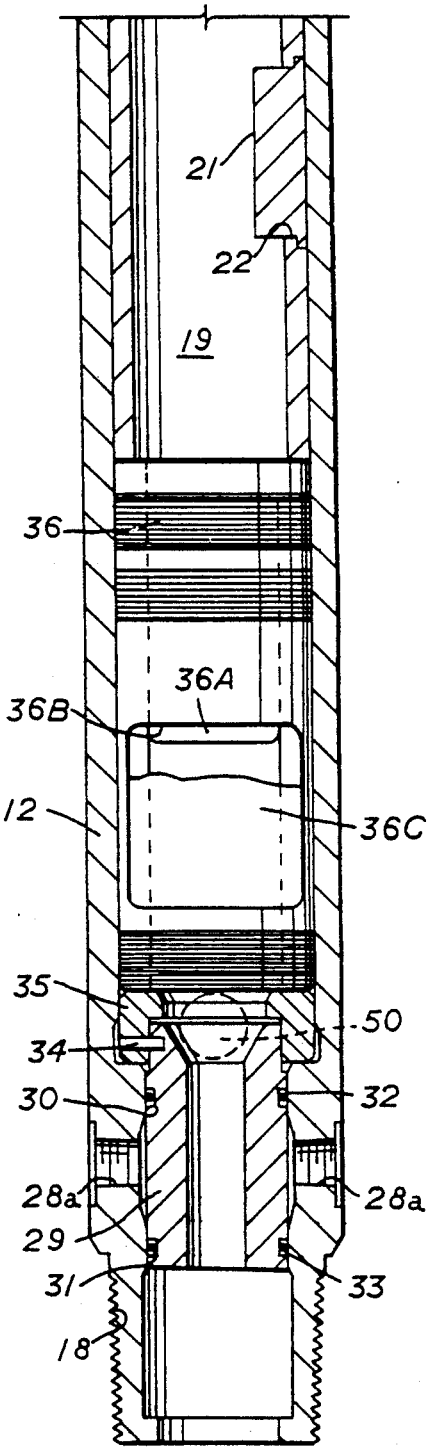

Circulating and orienting sub or tool 9 (see FIG. 5) comprises a lower tubular housing portion 12 and an upper housing or connecting sub 13 (FIGS. 2A and 2B). Connecting sub 13 has female threads 14 at its upper end and male threads 15 and an open bore 16 extending longitudinally.

Lower housing portion 12 has female threads 17 at its upper end and male threads 18 at its lower end. A longitudinal passageway 19 extends the entire length of lower housing portion 12. An orienting, receiving sleeve 20 is fitted in the upper end of lower housing portion 12 and has an orienting key 21 supported in an opening 22 in the side wall thereof. Key 21 extends radially inward of passageway 19 and cooperates with the mule shoe as described below.

The upper end of lower housing portion 12 has a plurality of longitudinal splines 23 and grooves 24 which are equal in size and equally spaced around the wall of the housing. Sleeve 20 has a plurality of longitudinal splines 25 and grooves 26 which are equal in size and equally spaced therearound and fit the grooves 24 and splines 23 of housing portion 12. This system of grooves and splines permits installation of sleeve 20 in housing portion 12 with incremental adjustment of the angular orientation by amounts corresponding to the spacing of the grooves and splines in the connection. The upper end of sleeve 20 has a peripheral groove 27 sealed by O-ring 28.

The lower end of lower housing portion 12 has a plurality of side openings **28*a*. A seal sleeve 29 is positioned in closing relation to openings and has upper and lower grooves 30 and 31 sealed by O-rings 32 and 33, respectively. The upper end of seal sleeve 29 is keyed by shear pin 34 to retainer ring 35**.

An annular, elongated float valve 36 (a modified Baker float valve) is positioned between the upper surface of retainer ring 35 and the bottom end of orienting sleeve 20. Baker float 36 is open longitudinally and forms part of the passageway extending the entire length of the orienting sub or tool 11. Float valve 36 has a flapper check valve **36*a*, spring loaded closed, about half way along its length. The side opening 36*b* in float valve 36 is closed by a metal cover 36*c*** tack welded in place.

Figure 3:
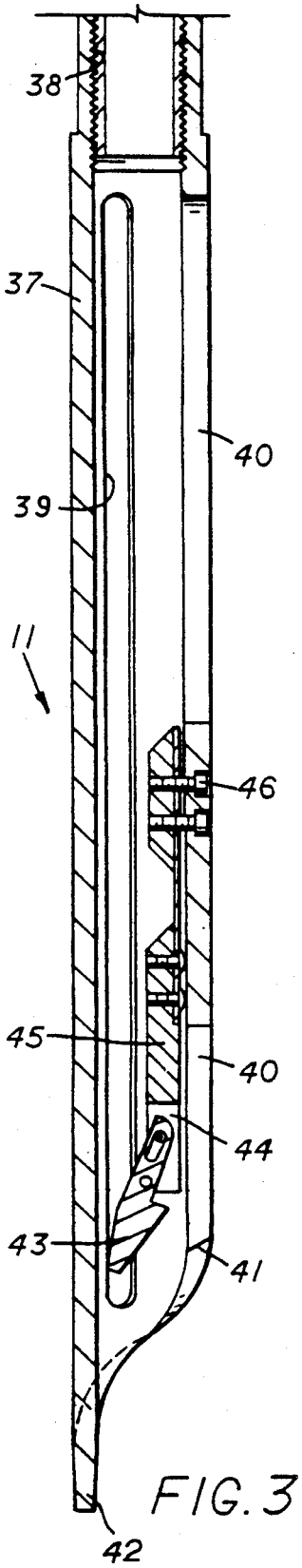
FIG. 3 is a longitudinal cross section of a mule shoe sub used to key the surveying tool to the orienting tool or sub.
Figure 4:
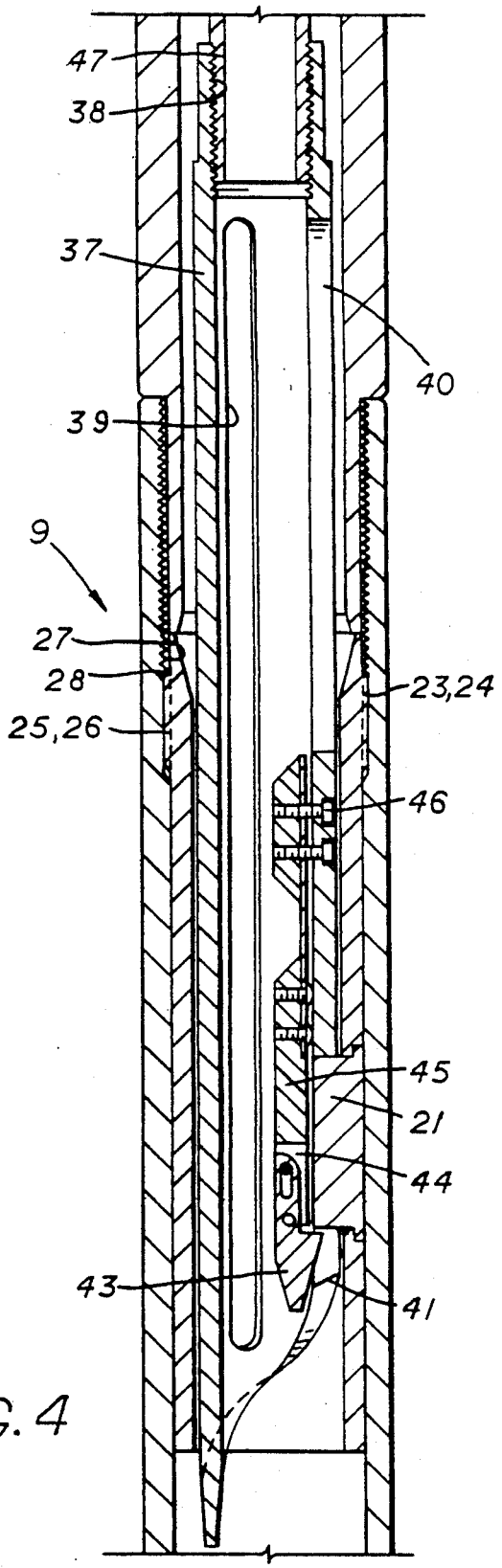
FIG. 4 is a longitudinal cross section of a mule shoe sub of FIG. 3 in place keying the surveying tool to the orienting tool or sub.

Mule shoe keying sub 11 is shown in FIG. 3 and its connection to orienting sub 9 is shown in FIG. 4. Mule shoe keying sub 11 comprises a tubular housing 37 which is internally threaded as at 38 for connection to the surveying tool 10. Tubular housing 37 has a plurality of longitudinal slots 39 and 40 and is cut away as shown at 41 to a guide tip portion 42. A spring-loaded latch member 43 is pivotally supported on the end 44 of latch support member 45 secured by machine screws 46 to the wall of tubular housing 37.

Referring now to FIGS. 6A through 8, the bypass tool or sub 8 comprises an outer tubular housing 47 (also called a drive sub) with an inner tubular housing 48 (also called an orifice shaft) telescoped inside for longitudinal sliding movement therein and having a telescoped position and an extended position. Outer tubular housing 47 is formed of two sections 49 and 50 which are threadedly secured together as described below.

Tubular housing or drive sub 47 has an enlarged bore 51 in the upper portion and a smaller bore 52 in the lower section with a tapered transition surface 53 therebetween. Tubular housing or orifice shaft 48 has a larger outside diameter portion 54 at its upper end and a smaller outside diameter portion 55 at its lower end with a tapered transition surface 56 therebetween. Tubular housing or orifice shaft 48 is positioned for longitudinal sliding movement in tubular housing or drive sub 47 with larger O.D. portion 54 sliding in enlarged bore 51 and smaller O.D. portion 55 sliding in smaller bore 52. The smaller O.D. portion 55 which slides in smaller bore 52 functions as a sliding plug valve for opening and closing the bypass as will be described more fully below.

The upper end of tubular housing 48 is enlarged as indicated at 57 forming a threaded box 58 for connection to the orienting sub 9. The lower end of tubular housing 47 terminates in a threaded pin portion 59 for connection to the upper end of the bent sub 7 or motor 5. The mid-section 60 (FIG. 6B) of the housings 47 and 48 is configured in a noncircular, e.g., polygonal or splined, cross section **47*a* and 48*a* (FIG. 8) which permits longitudinal sliding movement of the housings while restraining them from relative rotary movement. This construction allows rotary movement to be transferred from the drill string 4 and orienting sub 9 to down hole motor 5**.

The bore 61, extending the entire length of tubular housing or drive sub 48 and the smaller I.D. bore 52 in the lower end of tubular housing or orifice shaft 47 form a continuous passage for conducting drilling fluid from the surface from drill string 4 and orienting sub 9 to down hole motor 5. The outer lower wall portion of tubular housing 47 has one or more apertures or openings 62 extending from the smaller I.D. bore 52 to the outer surface of the tool for discharge of drilling fluid therethrough when the tool is extended to an operated position. A cylindrical screen 63 surrounds and is secured to housing section 16 to prevent debris or cuttings from the bore hole from entering the bypass tool.

The outer tubular housing or drive sub 47 comprises two separate sections with male threads 64 on upper section 49 and female threads 65 on lower section 50. The male and female threads 64 and 65 are threaded together with the end of the male threaded portion defining a stop shoulder 66 in the enlarged bore portion 51 of threaded housing section 50.

The enlarged bore portion of the upper end of drive sub 47 has a cylindrical bearing 67 of a suitable bearing metal or a hard rubber. Bearing 67 is secured in place by set screws 68 and is sealed by O-rings 69 and 70. A wiper ring retainer 71 is secured in place against the end of bearing 67 by snap ring 72 and retains a wiper ring 73.

The lower end of the enlarged O.D. portion of orifice shaft 48 is threaded at 74 and has a retaining nut 75 threadedly secured thereon. Retaining nut 75 has a smooth cylindrical external surface with (Parker) Molygard wear rings 76 for wear protection and O-ring 77 to seal against the bore of drive sub lower section 50. The lower end 78 of retaining nut 75 abuts a shoulder 79 in drive sub lower section 50 and limits the extent of telescoping movement of the tool housings. A hole or aperture 80 opens through the wall of orifice shaft 48 into the space above retaining nut 75 and intersects a groove 81 for applying pressure into the region from above retaining nut 75 to the lower end of bearing 67.

The lower, small O.D., end 55 of orifice shaft 48 extends through the smaller bore 52 in drive sub lower section 50 and is sealed peripherally by O-rings 82 to function as a sliding plug valve. Longitudinal movement of orifice shaft 48 in drive sub 47 will move the lower end 55 and O-rings 82 past the side openings 62 in drive sub 47 opening the normally closed valve to permit drilling fluid to exhaust from the bypass tool ahead of down hole motor 5 to flush the well bore of cuttings and debris.

OPERATION

Referring now to FIG. 1, when an existing well is used as a base, a 60 to 80 foot section is milled out of the casing starting 30 feet above the kickoff point, and a cement plug is placed in the milled out section.

The cement is dressed down to the kickoff point. The 30 foot section above it gives adequate room to orient the bottom hole assembly (BHA) using the steering tool magnetics. The hole is kicked off about 20 feet. The pipe is then tripped and the side-cutting drill bit and turn assembly are run back into the hole. It should be understood that it would also be possible to exit the hole via a conventional whipstock and milled window.

The "turning" drilling assembly drills a fixed curve that is a function of the tool face orientation and, to a lesser degree, the formation. As the bit drills along the curve, it may be necessary to modify the assembly to keep the turn on track. During the drilling of the curve, the hole is closely monitored with a steering tool and short interval calculations to avoid changes in the inclination or azimuth. When the bottom hole assembly (BHA) reaches horizontal, a straight hole assembly is installed.

When drilling the horizontal hole, the drag increases with each foot, so it is important to keep the hole straight and provide as much well bore lubrication as possible.

Because of the small pipe diameters, the present slim hole drilling system is flexible and easy to steer. The tool face can be turned easily and the change in drilling direction is rapid because of the limber system. As a result, the bit will drift off course if not continuously monitored. In systems with drill pipe diameters less than 3½", single shot surveys are not adequate.

The internal clearances in the bottom hole assembly, particularly at the steering mule shoe latch and at the motor, are tight in the smaller assemblies and it is suggested not to add any type of lost circulation materials except dilute quantities of mica. A preferred drilling technique is to drill depleted formations with an underbalanced fluid column. Low mud weights require careful attention to hole conditions, but there is a significant payoff in higher drilling rates and reduced lost circulation problems, as well as protecting the formation.

The operation of the system of apparatus described above is described more fully below as a preferred system of slim hole drilling.

This apparatus is assembled and operated by assembling the motor 5, bent sub 7, bypass tool or sub 8, and orienting sub or tool 9 on the drill pipe 4. Alternatively, bypass sub or tool 8 may be installed directly to the housing of the bent motor 5 or straight motor if the bent sub 7 is not used.

Orienting sleeve 20 is adjusted angularly, as shown in FIG. 5, to position key 21 in alignment with the bend in bent sub 7, or alternatively, the bend in bent motor housing 5. With the orienting sleeve 20 properly positioned, mule shoe sub 11 is first installed on the lower end of surveying tool 10 and then slid into the upper end of the orienting sub 9. As mule shoe sub 11 is slid into position, the lower portion of slot 40 and the guide portion 41 and 42 engages key 21 and guides the connection until the end of slot 40 engages the upper end of key 21 and latch 43 snaps into latching position as seen in FIG. 4.

With the orienting sub 9 and bypass tool 8 connected in place as just described, the bend in bent sub 7 or in bent motor housing 5 is properly aligned with surveying tool 10 so that it can control the drilling in the direction of the bend.

Drilling mud (or other drilling fluid) is pumped through the drill pipe 4, the orienting sub or tool 10, the bypass tool 8 and through the motor 5 and out through the drill bit 6. The flow of the drilling mud (or other drilling fluid) through the motor 5 causes it to rotate at high speed to turn the drill bit 6 for drilling the hole. As previously noted, the apparatus has been described with a Moineau type positive displacement motor although other fluid-operated motors, such as turbines and the like, may be used.

The Baker float valve 36 with flapper valve **36*a* protects the equipment against backflow of drilling fluid or formation fluids. The sleeve valve 29 normally closes the bypass ports 28. When the drill string is being lifted, it is desirable to unload the drilling fluid to reduce the lifting load. To accomplish this, a ball 50 (shown in dotted line) is dropped into the drill string. Ball 50 is of a size permitting it to pass through the drill string and orienting sub 9 to close against the seat of the sleeve valve 29. The application of fluid pressure against the ball 50 will shear the pin 34 and move sleeve valve 29 downward to open valve ports 28** and allow drilling fluid to flow out from the drill string.

The combining of the Baker float valve 36 and sleeve valve 29 into this apparatus produces a structure which is substantially shorter than conventional equipment where functions of this type have been provided in separate tool components. This permits the surveying tool 9 to be located close to the motor 5 and produces more accurate control of the drilling.

When the bypass tool or sub 8 is telescoped or collapsed, as in FIGS. 1, 6A and 6B, O-ring seals 82 close off the bypass openings or ports 62. With the tool in the closed position, all of the drilling fluid passes through the down hole drilling motor 5.

When the orifice shaft 48 is lifted, the tool extends, allowing the seals 82 to move upward past the bypass openings or ports 62 and allowing drilling fluid to flow directly into the well bore annulus and bypass the down hole drilling motor 5. The screen 63 covering the bypass ports 62 prevents drill cuttings or other debris from entering the tool and plugging the motor 5 or drill bit 6.

When the tool is in the closed position, if it were not for the pressure balancing arrangement used herein, the tool would tend to open or extend as soon as internal pressure is applied to the tool. The hydraulic or fluid force tending to open the tool (in the unbalanced state) equals:

$$F_H = \pi D_1^2 P/4 \text{ (lbs.)}$$

where $D_1$ = Seal diameter (inches)

P = Differential pressure (p.s.i.)

and where $$P = P_I - P_A$$

and $P_I$ = Internal pressure (p.s.i.)

$P_A$ = Annulus pressure (p.s.i.)

The differential pressure drop equals:

$$P = P_{motor} + P_{bit}$$

where $P_{motor}$ = Pressure drop across the motor (p.s.i.)

$P_{bit}$ = Pressure drop across the bit (p.s.i.)

The hydraulic opening force tending to open the unbalanced tool can be large. In a 4-inch diameter tool the opening force is nearly 8,000 lbs. In such a case, the weight required to close the tool would be the opening force plus the bit weight plus the motor weight. This high bit weight may cause the bit torque to exceed the motor output torque and stall the motor. For this reason, the balanced design described above is preferred.

In the balanced design, described above, there are three separate sliding seals: the seals 82 at the sliding valve; the seals 77 at the retaining nut 75; and the seals 69 and 70 at the upper bearing 67.

The tool is designed so that the upward directed force ($F_{opening}$) tending to open the tool is:

$$F_{opening} = \pi D_1^2 P/4$$

and a downward directed force ($F_{closing}$) tending to close the tool equal to:

$$F_{closing} = \pi (D_2^2 - D_3^2) P/4$$

where $D_1$ = diameter of sealing surface of seal 69

$D_2$ = diameter of sealing surface of seal 77

$D_3$ = diameter of sealing surface of seal 82

The net force ($F_{net}$) tending to close or to open the tool equals:

$$F_{net} = F_{opening} - F_{closing}$$

$$F_{net} = \pi (D_2^2 + D_3^2) P/4$$

The net force tends to open the tool when $F_{net}$ is greater than 0 and close the tool when $F_{net}$ is smaller than 0.

The tool is hydraulically balanced when $F_{net} = 0$. where $D_2^2 + D_3^2$.

The total bit weight ($F_{bit}$) required to close the tool equals:

$$F_{bit} = F_{net} + W_B + W_M$$

where $W_B$ = Weight of bit (lbs.)

$W_M$ = Weight of motor (lbs.)

The net force can be adjusted, by proper design, to compensate exactly for the weight of the bit and motor. The tool will close when thrust is first applied to the drill bit and it will open when the drill string is raised to lift the orifice sub in the tool. Generally, the tool is designed with some small net force tendency to open since there are always frictional forces to be overcome. The tool shown and described above is substantially balanced. However, if an unbalanced design is desired, it is produced by plugging the opening 80 and eliminating seals 77 on the retaining nut 75.

While this invention has been described fully and completely with special emphasis upon several preferred embodiments it should be understood that within the scope of the appended claims the invention may be practiced otherwise than as specifically described herein.

We claim:

1. A system of apparatus for the controlled directional drilling of a deviated well bore into the earth comprising;

a drill string extending into a substantially vertical well bore in the earth, a fluid operated motor and drill bit operated thereby secured on the bottom end of said drill string, means supporting at least a part of said motor and drill bit at a substantial angle to said substantially vertical well bore for continuing the drilling of said well bore at an angle to the substantially vertical portion thereof, a surveying tool connected in said drill string above said motor for determining and controlling the direction of drilling, a mule shoe keying sub connected to said surveying tool for orienting the position of said motor in relation to said surveying tool, and an orienting sub connected to said surveying tool by said mule shoe keying sub at one end and connected at the other end to said means supporting said motor at an angle, and including means to adjust the angular orientation of the point of connection to said mule shoe keying sub in relation to said means supporting said motor at an angle.

2. A system of apparatus according to claim 1 including a bypass tool connected in said drill string above said motor in fluid connection therewith and having valve means for circulating fluid into the bore hole to flush cuttings and debris therefrom.

3. A system of apparatus according to claim 1 in which said motor has a deflection pad on its housing positioned to act as a fulcrum and increase the side load on the drill bit, causing it to drill along a sharper curve.

4. A system of apparatus according to claim 1 in which said motor is connected to said drill string by a bent sub, and said angular adjusting means being operable to adjust the orientation of the point of connection to said mule shoe keying sub in relation to the bend in said bent sub to position said motor and drill bit in the same plane as said surveying tool.

5. A system of apparatus according to claim 1 in which said motor has a bent housing, and said angular adjusting means being operable to adjust the orientation of the point of connection to said mule shoe keying sub in relation to the bend in said motor housing to position said motor and drill bit in the same plane as said surveying tool.

6. A system of apparatus according to claim 1 in which said motor is connected to said drill string by a bent sub, said motor has a bent housing, and said angular adjusting means being operable to selectively adjust the orientation of the point of connection to said mule shoe keying sub in relation to the bend in said bent sub or in relation to the bend in said motor housing to position said motor and drill bit in the same plane as said surveying tool.

7. A system of apparatus according to claim 1 in which said orienting sub has a key member connected to said mule sub to orient said orienting sub to a predetermined position in relation to said mule sub and said surveying tool, and said angular adjusting means comprises means to adjust the angular orientation of said key member in said orienting sub.

8. A system of apparatus according to claim 7 in which said orienting sub comprises a tubular housing, including a tubular sleeve fitted therein to support said key member, and said angular adjusting means comprises means to adjust the angular orientation of said sleeve in said housing.

9. A system of apparatus according to claim 8 in which said tubular housing has a plurality of internal, longitudinally extending grooves and splines at one end thereof and equally spaced circumferentially therein, said tubular sleeve has a plurality of external, longitudinally extending grooves and splines at one end thereof sized and spaced to fit said grooves and splines in said housing, and said splines and grooves in said housing and said sleeve cooperating to comprise said angular adjusting means for adjusting the angular orientation of said sleeve in said housing.

10. A system of apparatus according to claim 2 in which said motor is connected to said drill string by a bent sub or bent housing, and said bypass tool has a lower end connected in said drill string to the upper end of said bent sub or bent housing.

11. A system of apparatus according to claim 2 in which said bypass tool having a tubular housing telescopically operable to have a telescoped position and an extended position and at least one opening through the wall thereof for conducting drilling fluid therethrough to flush out the well bore, and bypass valve means closing said at least one opening in the telescoped position and being opened by movement of said housing to the extended position to permit drilling fluid to flow through said valve means and said at least one opening to circulate fluid into the bore hole to flush cuttings and debris therefrom.

12. A system of apparatus according to claim 10 in which said bypass tool comprises;

a first tubular housing, a second tubular housing telescoped inside said first housing for longitudinal sliding movement therein and having a telescoped position and an extended position, one of said housings having an open lower end and the other of said housings having an upper open end, one of said open ends being connected to one end of said means supporting at least a part of said down hole motor in fluid communication therewith, the outer one of said housings having an opening through the wall thereof for conducting drilling fluid therethrough to flush out the well bore, means on said inner and outer housings forming a valve closing said outer housing opening when said housings are in said telescoped position and being opened by movement of said housings to said extended position, whereby lifting said upper housing moves it to said extended position opening said valve to permit drilling fluid to flow through said valve and said outer housing opening to circulate fluid into the bore hole to flush cuttings and debris therefrom.

13. A system of apparatus according to claim 11 in which said motor is connected to said drill string by a bent sub, and said bypass tool housing having an open lower connected in said drill string to the upper end of said bent sub.

14. A system of apparatus according to claim 12 in which said motor has a bent housing, and said bypass tool housing open lower end is adapted for connection in said drilling string to the upper end of said bend in said motor housing.

15. A system of apparatus according to claim 12 in which said bypass tool housings have non-circular cross sections in at least a part of the portion having telescoping sliding contact to facilitate transmission of rotary motion from one housing to the other.

16. A system of apparatus according to claim 15 in which said non-circular cross sections of said bypass toll housings are regular polygons.

17. A system of apparatus according to claim 12 in which said bypass tool further includes means, positioned in one of said housings exposed to drilling fluid in the housing, operable to apply a thrust to said telescopically moved housing substantially counterbalancing part or all of the force applied to said housings tending to move said housings to an extended position.

18. A system of apparatus according to claim 17 in which said bypass tool thrust-applying means comprises fluid pressure operated means positioned on the fluid inlet side of said housings relative to said valve, including an opening through the wall of said inner housing into the space between said housings, and an opening through the wall of said outer housing into the bore hole whereby the pressure introduced between said housings on opening of said valve is substantially counterbalanced by pressure applied from inside said inner housing through said first named opening into the space between said housings.

19. A system of apparatus according to claim 12 in which said first bypass tool tubular housing having an enlarged bore extending from the upper end to a smaller bore extending through the lower end thereof and at least one opening in the wall thereof from the smaller bore, and said bypass tool second tubular housing having a larger outside diameter portion telescoped inside said first housing enlarged bore and a smaller outside diameter portion telescoped inside said first housing smaller bore for longitudinal sliding movement therein, said second tubular housing smaller outside diameter portion forming a plug valve inside said first tubular housing smaller bore when said housings are in said telescoped position, whereby lifting said second tubular housing moves it to said extended position moving said smaller outside diameter portion valve surface out of closing relation to said first tubular housing smaller bore and opening said valve to permit drilling fluid to flow through said valve and said outer housing opening to circulate fluid into the bore hole to flush cuttings and debris therefrom.

20. A system of apparatus according to claim 19 in which said bypass tool first tubular housing comprises two separate sections with male threads on one section and female threads on the other section, said male and female threads being threaded together with the end of the male threaded portion defining a stop shoulder in the enlarged bore portion of said female threaded housing portion, said second tubular housing larger outside diameter portion having a threaded end portion adjacent to said smaller outside diameter portion, a retaining nut threadedly secured on said threaded end portion and engageable with said stop shoulder on telescoping movement of said housings to said extended position, and said retaining nut having a smooth bearing surface and peripheral seal for gas-tight sliding contact with the inner surface of said enlarged bore portion.

21. A system of apparatus according to claim 20 in which said bypass tool second tubular housing having an opening through the wall thereof from the interior of the housing into the space between said second tubular housing and the enlarged bore of said first tubular housing at a point above said retaining nut to apply pressure of fluid flowing through said tool against the upper surface of said retaining nut to counter balance the pressure introduced below the retaining nut when said housings are in a telescoped position.

22. A system of apparatus according to claim 20 in which at least part of said enlarged bore of said bypass tool first tubular housing has a non-circular cross section, and at least part of said second tubular housing larger outside diameter portion housing has a non-circular cross section sized for a sliding fit with said first named non-circular cross section to facilitate transmission of rotary motion from one housing to the other.

23. A system of apparatus according to claim 20 in which at least part of said enlarged bore of said bypass tool first tubular housing has a hexagonal cross section, and at least part of said bypass tool second tubular housing larger outside diameter portion housing has a hexagonal cross section sized for a sliding fit with said first named non-circular cross section to facilitate transmission of rotary motion from one housing to the other.

24. A system of apparatus according to claim 20 in which said bypass tool first tubular housing comprises two separate sections with male threads on one section and female threads on the other section, said male and female threads being threaded together with the end of the male threaded portion defining a stop shoulder in the enlarged bore portion of said female threaded housing portion, said bypass tool second tubular housing larger outside diameter portion having a threaded end portion adjacent to said smaller outside diameter portion, a retaining nut threadedly secured on said threaded end portion and engageable with said stop shoulder on telescoping movement of said housings to said extended position, said retaining nut having a smooth bearing surface and peripheral seal for gas-tight sliding contact with the inner surface of said enlarged bore portion, and said bypass tool second tubular housing having an opening through the wall thereof from the interior of the housing into the space between said second tubular housing and the enlarged bore of said first tubular housing at a point above said retaining nut to apply pressure of fluid flowing through said tool against the upper surface of said retaining nut to counter balance the pressure introduced below the retaining nut tending to move said housings to an extended position with said valve open to permit fluid flow through said opening in said first tubular casing into the bore of the hole being bored by said down hole motor.

25. A system of apparatus according to claim 24 in which at least part of said enlarged bore of said bypass tool first tubular housing has a non-circular cross section, and at least part of said bypass tool second tubular housing larger outside diameter portion housing has a non-circular cross section sized for a sliding fit with said first named non-circular cross section to facilitate transmission of rotary motion from one housing to the other.

26. A system of apparatus according to claim 24 in which at least part of said enlarged bore of said first bypass tool tubular housing has a hexagonal cross section, and at least part of said bypass tool second tubular housing larger outside diameter portion housing has a hexagonal cross section sized for a sliding fit with said first named non-circular cross section to facilitate transmission of rotary motion from one housing to the other.

27. A system of apparatus according to claim 24 in which said retaining nut includes a wear ring for wear resistance and an O-ring seal, and a cylindrical radial bearing and O-ring seal positioned between the upper ends of said bypass tool tubular housings.

28. A method for controlled directional drilling of a bore hole, according to a predetermined well plan, utilizing a bottom hole assembly connected to a drill string comprising a drill bit connected for independent rotation from said drill string to the output shaft of a down hole motor, comprising the steps of;

installing on the drill string above the down hole motor and in fluid connection therewith, a system of apparatus comprising; a bypass tool having valve means for circulating fluid into the bore hole to flush cuttings and debris therefrom, a surveying tool capable of determining and controlling the direction of drilling, and an orienting tool capable of orienting the position of said motor in relation to said surveying tool, supporting at least a part of said motor and drill bit at a substantial predetermined angle beneath said system of apparatus relative to the vertical portion of a bore hole to form an interacting down hole assembly for drilling of said bore hole at a predetermined angle to the substantially vertical portion thereof, selectively adjusting the angular orientation of said motor in relation to said apparatus supporting same in accordance with the well plan, pumping a suitable drilling fluid through said apparatus and motor and out through the drill bit to rotate said bit for drilling the bore hole along a curved path as determined by the angular orientation of said motor, continuously monitoring said surveying tool during the drilling operation to determine and control the direction of drilling and at selected times readjusting the angular orientation of said motor in relation to said surveying tool, and operating said bypass tool valve means to selectively direct fluid through the motor housing to rotate said bit or to circulate fluid into the bore hole to flush cuttings and debris therefrom in accordance with the well plan.

29. A method according to claim 28 in which said step of supporting at least a part of said motor and drill bit at a substantial predetermined angle beneath said apparatus comprises connecting said motor to said drill string by a bent sub, and said step of selectively adjusting or readjusting the angular orientation of said motor comprises positioning said orienting tool to adjust the angular orientation of the point of connection in relation to the bend in said bent sub.

30. A method according to claim 29 in which said step of supporting at least a part of said motor and drill bit at a substantial predetermined angle beneath said apparatus comprises connecting said motor to said drill string by a bent sub, and said step of selectively adjusting or readjusting the angular orientation of said motor comprises positioning said orienting tool to adjust the angular orientation of the point of connection in relation to the bend in said bent sub to position said motor and drill bit in the same plane as said surveying tool.

31. A method according to claim 29 in which said step of supporting at least a part of said motor and drill bit at a substantial predetermined angle beneath said apparatus comprises providing a down hole motor having a bent housing and connecting said bent housing motor to said drill string, and said step of selectively adjusting or readjusting the angular orientation of said motor comprises positioning said orienting tool to adjust the angular orientation of the point of connection in relation to the bend in said bent motor housing.

32. A method according to claim 29 in which said step of supporting at least a part of said motor and drill bit at a substantial predetermined angle beneath said apparatus comprises providing a down hole motor having a bent housing and connecting said bent housing motor to said drill string, and said step of selectively adjusting or re-adjusting the angular orientation of said motor comprises positioning said orienting tool to adjust the angular orientation of the point of connection in relation to the bend in said bent motor housing to position said motor and drill bit in the same plane as said surveying tool.

33. A method according to claim 32 in which said step of supporting at least a part of said motor and drill bit at a substantial predetermined angle beneath said apparatus comprises providing a bent sub and a down hole motor having a bent housing and connecting said bent housing motor to said drill string by said bent sub, and said step of selectively adjusting or re-adjusting the angular orientation of said motor comprises positioning said orienting tool to adjust the angular orientation of the point of connection to the bend in said bent sub or in relation to the bend in said bent motor housing.

34. A method according to claim 32 in which said step of supporting at least a part of said motor and drill bit at a substantial predetermined angle beneath said apparatus comprises providing a bent sub and a down hole motor having a bent housing and connecting said bent housing motor to said drill string by said bent sub, and said step of selectively adjusting or re-adjusting the angular orientation of said motor comprises positioning said orienting tool to adjust the angular orientation of the point of connection to the bend in said bent sub or in relation to the bend in said bent motor housing to position said motor and drill bit in the same plane as said surveying tool.

35. A method according to claim 32 in which said bypass tool comprises a first tubular housing and a second tubular housing telescoped inside said first housing for longitudinal sliding movement therein and having a telescoped position and an extended position and means to facilitate transmission of rotary motion from one housing to the other, one of said housings having an open lower end and the other of said housings having an upper open end, one of said open ends being connected beneath said orienting tool and the other open end supporting at least a part of said motor and drill bit at a substantial predetermined angle, the outer one of said housings having an opening through the wall thereof for conducting drilling fluid therethrough to flush out the well bore, means on said inner and outer housings forming a valve closing said outer housing opening when said housings are in said telescoped position and being opened by movement of said housings to said extended position, and said step of selectively operating said bypass tool valve means and circulating fluid into the bore hole to flush cuttings and debris therefrom comprises lifting said upper housing to move the same to said extended position opening said valve to permit drilling fluid to flow through said valve and said outer housing opening to circulate fluid into the bore hole.

36. A method according to claim 32 in which said motor is connected to said drill string by a bent sub, and the placement of said system of apparatus in said drill string is as follows, said bypass tool is placed above said bent sub, said orienting tool is placed above said bypass tool, said surveying tool is placed above said orienting tool, and said surveying tool is connected to the lower end of the drill string.

37. A method according to claim 32 in which said down hole motor having a bent housing and is connected to said drill string by said bent housing, and the placement of said system of apparatus in said drill string is as follows, said bypass tool is placed above said bent motor housing, said orienting tool is placed above said bypass tool, said surveying tool is placed above said orienting tool, and said surveying tool is connected to the lower end of the drill string.

38. A method according to claim 32 in which said down hole motor having a bent housing and is connected to said drill string by a bent sub, and the placement of said system of apparatus in said drill string is as follows, said bypass tool is placed above said bent sub, said orienting tool is placed above said bypass tool, said surveying tool is placed above said orienting tool, and said surveying tool is connected to the lower end of the drill string.

* * * * *